US009108705B2

(12) United States Patent
Hartelius

(10) Patent No.: US 9,108,705 B2
(45) Date of Patent: Aug. 18, 2015

(54) SEMI-RIGID FLOATING TUBE ASSEMBLY

(71) Applicant: Mark Hartelius, Chicago, IL (US)

(72) Inventor: Mark Hartelius, Chicago, IL (US)

( * ) Notice: Subject to any disclaimer, the term of this patent is extended or adjusted under 35 U.S.C. 154(b) by 0 days.

(21) Appl. No.: 14/189,827

(22) Filed: Feb. 25, 2014

(65) Prior Publication Data

US 2014/0364024 A1 Dec. 11, 2014

Related U.S. Application Data

(60) Provisional application No. 61/770,478, filed on Feb. 28, 2013.

(51) Int. Cl.
*B63B 35/73* (2006.01)

(52) U.S. Cl.
CPC ..... *B63B 35/73* (2013.01)

(58) Field of Classification Search
CPC ..... B63B 35/73
USPC ..... 441/129–132
See application file for complete search history.

(56) References Cited

U.S. PATENT DOCUMENTS

| | | | | |
|---|---|---|---|---|
| 4,424,043 | A * | 1/1984 | Behl | 441/81 |
| 5,628,658 | A * | 5/1997 | Clifford | 441/130 |
| 5,947,782 | A * | 9/1999 | Siladke et al. | 441/129 |
| D421,085 | S * | 2/2000 | Fife et al. | D21/803 |
| 6,199,676 | B1 * | 3/2001 | Targiroff | 193/25 B |
| 6,276,979 | B1 * | 8/2001 | Saltel et al. | 441/132 |
| 6,749,475 | B2 * | 6/2004 | Howerton | 441/132 |
| 7,008,281 | B2 * | 3/2006 | Ketko | 441/130 |
| 7,798,879 | B2 * | 9/2010 | James et al. | 441/118 |
| 8,147,286 | B2 * | 4/2012 | Messina | 441/80 |
| 8,651,909 | B2 * | 2/2014 | Romzek | 441/129 |
| 2005/0026520 | A1 * | 2/2005 | Howerton | 441/132 |
| 2005/0106963 | A1 * | 5/2005 | Ross | 441/129 |
| 2014/0364024 | A1 * | 12/2014 | Hartelius | 441/129 |

OTHER PUBLICATIONS

Floating canvas roll Pillow—believed prior art www.PoolFloatSmart.com, Dec. 6, 2010.
'PoolNoodles' made by LIFOAM Industries MD—believed prior art, Jul. 9, 2009.
'New 1/4" Plastic Flexible Coolant Oil Hose Pipe Milling Lathe'—Ebay advertisement—modular semi-rigid tubing—believed prior art, Aug. 14, 2011.

* cited by examiner

*Primary Examiner* — Lars A Olson
*Assistant Examiner* — Jovon Hayes
(74) *Attorney, Agent, or Firm* — Robert W. J. Usher

(57) ABSTRACT

An amusement device is formed by an elongate, semi-rigid, floating tube assembly with an outer, sleeve-forming tube of soft, flexible, buoyant material and semi-rigid, modular, inner tubing inserted longitudinally into the sleeve. The inner tubing is assembled from a series of identical, rigid, tubular, plastic links each having ball and a socket joint at respective opposite ends rotatively engaged with respective socket and ball joints of adjacent links. The engaging/abutting surfaces of the joints form interference, watertight fits to join the links in end-to-end relation to any desired length and enabling the tube assembly to be transversely bent by a person into different stable shapes. A creaking sound, audible to a user, is emitted during rotative movement of the joints during transverse bending of the tube assembly.

8 Claims, 1 Drawing Sheet

SEMI-RIGID FLOATING TUBE ASSEMBLY

RELATED APPLICATION

Priority is claimed from my U.S. provisional application 61/770,478 filed Feb. 28, 2014, the disclosure of which is incorporated herein by reference.

BACKGROUND OF THE INVENTION

Elongate, floating tubes, sometimes known as pool noodles, provided for both amusement and as buoyancy aids are well known from the prior art. They are often made of soft, flexible closed cell foam such as EPE foam. Although some versions have rigid tubing to create a water launcher, a particularly appealing property in the absence of rigid tubing is that they can easily be bent transversely into different shapes by a person during use. However, a disadvantage of the prior proposals is that, the final or stable shape depends on the foam memory (resiliency) and it is therefore necessary for the user to manually hold the tube device in any desired deformed shape.

SUMMARY OF THE INVENTION

It is an object of the invention to overcome the above-mentioned disadvantage by providing a floating tube which maintains the shape into which it is deformed by the user without need for the user to manually hold it in shape.

According to one aspect of the invention, a floating tube assembly includes an outer flexible tube containing inner semi-rigid tubing which enables the tube assembly to be deformed by transverse bending by the user into any stable shape desired by the user while obviating any requirement for application of an external force (e.g. the user's grip) to hold the assembly in the deformed shape.

According to another aspect of the invention, the inner, semi-rigid tubing emits a creaking noise during bending between different shapes which is audible to the bender.

Thus, in some applications, a child user can both wind the tube assembly around his torso while hearing the creaking sound which adds to the amusement.

According to another aspect of the invention, an elongate, semi-rigid, floating tube assembly comprises an outer sleeve-forming tube of soft, flexible, buoyant material and modular, semi-rigid, inner tubing inserted longitudinally into the sleeve and comprising a series of identical, rigid, tubular, plastic links each having opposite ends provided respectively with a ball and a socket joint rotatively engaged with respective socket and ball joints of adjacent links respective socket and a ball joints of adjacent links with engaging/abutting surfaces in interference, watertight fits to join the links in end-to-end relation enabling the tube assembly to be transversely bent by a person into different stable shapes.

Preferably, a creaking sound, audible to a user, is emitted by rotative movement of the joints during transverse bending of the tube assembly.

Desirably, the ball and socket joints of each link are joined by a narrow neck portion.

BRIEF DESCRIPTION OF THE DRAWINGS

In order that the invention may be readily understood, a particular embodiment thereof will now be described with reference to the accompanying drawings in which.

PARTICULAR DESCRIPTION

Figure 1:
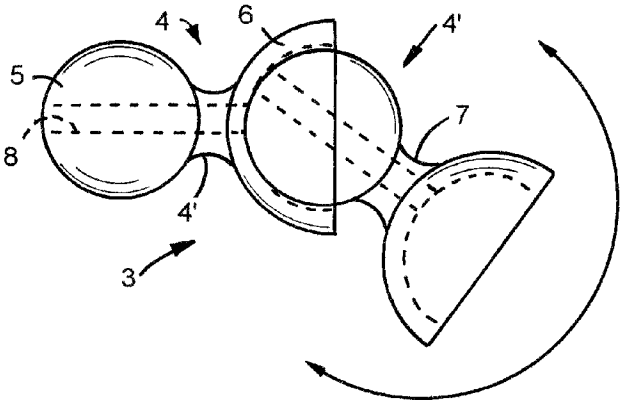
FIG. 1 is a schematic view showing two links of inner tubing of the tube assembly joined together for relative rotation.
Figure 2:
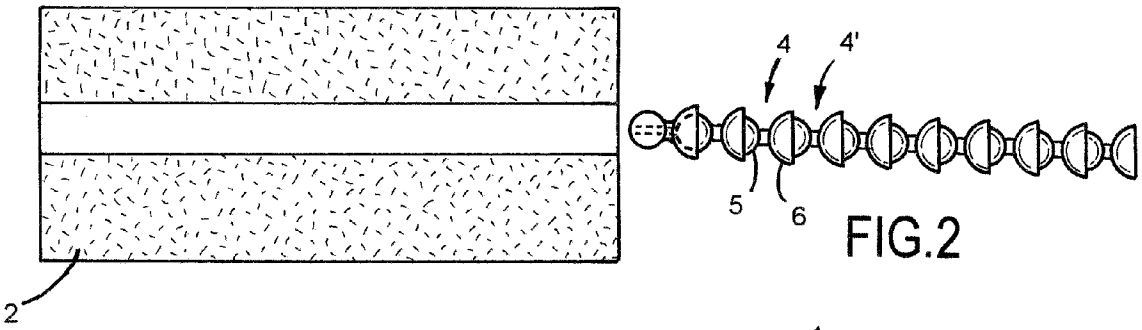
FIG. 2 is view is a longitudinal cross-sectional view of the outer, sleeve-forming tube of the tube assembly and inner tubing aligned for longitudinal insertion therein.
Figure 3:
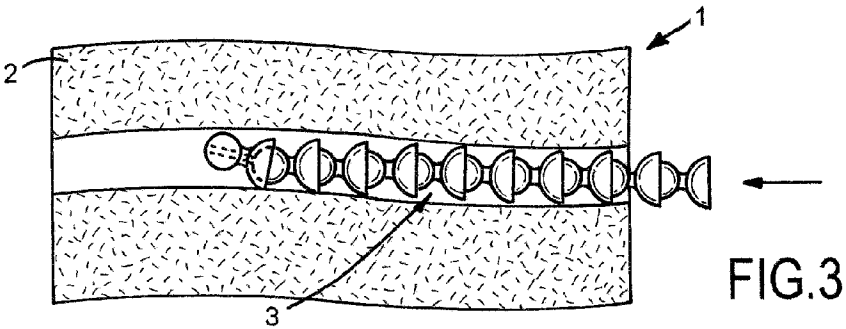
FIG. 3 is a similar view to FIG. 3 with the inner tubing partly inserted.

Referring to FIGS. 1-3, an elongate, semi-rigid, floating tube assembly 1 comprises an outer sleeve-forming tube 2 of soft, flexible, buoyant material, being a closed cell EPE foam, (preferably, non-phthalate) and modular, semi-rigid, inner tubing 3 insertable longitudinally into the outer tube 2. The inner tubing 3 comprising a series of identical, tubular rigid, plastic links 4, 4' each having opposite ends provided respectively with a ball 5 and a socket joint 6 joined together by a neck portion 7, rotatively engaged with socket and ball joints of adjacent links with respective abutting/engaging surface portions of the joints in interference, watertight fits, to join the links 4, 4' in end to end relation, enabling the tube assembly 1 to be transversely bent by a person into different stable shapes. Each link has a bore/duct 8 extending axially/longitudinally therethrough.

During relative movement, (as when transversely bending the tube assembly), the engaged joints emit a creaking sound audible to a user.

The inner modular inner tubing can be retained in the sleeve as an interference/friction fit or retained therein by optional end plugs/caps. The individual links can be snap-fitted together to provide semi-rigid inner tubing of any desired length. Ends of the sleeve assemble can be sealed using a silicone or bonding agent.

The ability for children to manually deform the assembly into any desired stable shape provides considerable amusement both in and out of the water, which is increased by the 'creaking bones' noise produce by their bending actions. The modular nature of the inner tubing enables bent assemblies to be joined together for enormous variations of lengths and shapes, forming, for example, a diving ring for a swimming pool or, completely wrapping aroun a person as a floatation aid.

The invention claimed is:

1. An elongate, semi-rigid, floating tube assembly comprising an outer sleeve-forming tube of soft, flexible, buoyant material and modular, semi-rigid, inner tubing inserted longitudinally into the sleeve and comprising a series of identical, rigid, tubular, plastic links having respective opposite ends provided respectively with ball and a socket joints rotatively engaged with respective socket and a ball joints of adjacent links with engaging/abutting surfaces in interference, watertight fits to join the links in end-to-end relation enabling the tube assembly to be transversely bent by a person into different stable shapes.

2. An elongate, semi-rigid, floating tube assembly according to claim 1, wherein a creaking sound audible to a user is emitted by rotative movement of the joints during transverse bending of the tube assembly.

3. An elongate, semi-rigid, floating tube assembly according to claim 2, wherein the ball and socket joints of each link are joined by a narrow neck portion.

4. An elongate, semi-rigid, floating tube assembly according to claim 1, wherein the outer tube material comprises a closed cell foam.

5. An elongate, semi-rigid, floating tube assembly according to claim 2, wherein the outer tube material comprises a closed cell foam.

6. A kit for making an elongate, semi-rigid, floating tube assembly comprising an outer tube of soft, flexible, buoyant material and modular, semi-rigid, inner tubing insertable longitudinally into the outer tube and comprising a series of identical, tubular rigid, plastic links having respective opposite ends provided respectively with ball and socket joints rotatively engaged with socket and ball joints of adjacent links with engaging/abutting surfaces in interference, watertight fits, to join the links in end to end relation enabling the tube assembly to be transversely bent by a person into different stable shapes.

7. A kit according to claim 6, wherein a creaking sound audible to a user is emitted by rotative movement of the joints during transverse bending.

8. A kit according to claim 7, wherein the ball and socket joints of each link are joined by a narrow neck portion.

* * * * *